United States Patent [19]

Ohno et al.

[11] 3,941,312

[45] Mar. 2, 1976

[54] INK JET NOZZLE FOR USE IN A RECORDING UNIT

[75] Inventors: Genji Ohno, Yokohama; Tadamitsu Uchiyama, Tokyo; Seisaku Ohki, Tokyo; Hishao Morohashi, Tokyo, all of Japan

[73] Assignee: Research and Development Laboratories of Ohno Company Limited, Japan

[22] Filed: Feb. 28, 1975

[21] Appl. No.: 554,020

Related U.S. Application Data

[62] Division of Ser. No. 418,283, Nov. 23, 1973.

[52] U.S. Cl. ..... 239/15; 239/102

[51] Int. Cl.[2] ..... B05B 5/00; F23D 11/28

[58] Field of Search ..... 239/3, 15, 102; 346/75

[56] References Cited

UNITED STATES PATENTS

| | | | |
|---|---|---|---|
| 3,656,171 | 4/1972 | Robertson | 239/15 |
| 3,700,169 | 10/1972 | Naydan et al. | 239/102 |
| 3,701,476 | 10/1972 | Houser | 239/15 |
| 3,776,461 | 12/1973 | Kashio | 239/15 |
| 3,848,118 | 11/1974 | Rittberg | 239/102 |

*Primary Examiner*—Lloyd L. King
*Attorney, Agent, or Firm*—Staas & Halsey

[57] ABSTRACT

A recording unit is disclosed which is provided with a hollow, very small nozzle supplied with a liquid imaging material, an electrode plate having formed therein a through hole coaxial with the nozzle and disposed opposite to the tip of the nozzle and a ring of small diameter disposed on the nozzle coaxially therewith in the vicinity of its tip or between the nozzle and the electrode plate. A convergent or unfluctuated jet of the liquid imaging material produced by a voltage applied between the nozzle and the electrode plate disposed opposite thereto is directed through the through hole of the electrode plate to a recording member or medium placed adjacent to the electrode plate on the opposite side from the nozzle. The convergent jet of the liquid imaging material thus produced is made intermittent by applying a voltage to the ring, thereby to record images.

15 Claims, 35 Drawing Figures

FIG.31
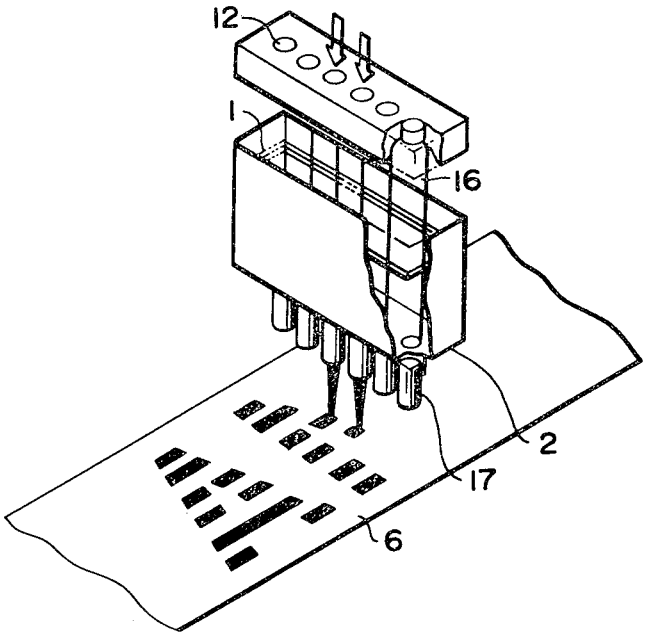
FIG.32
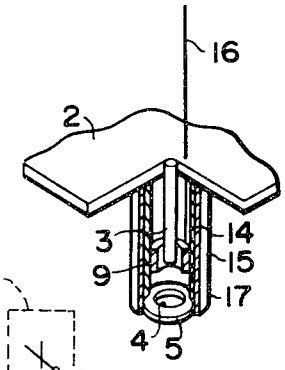
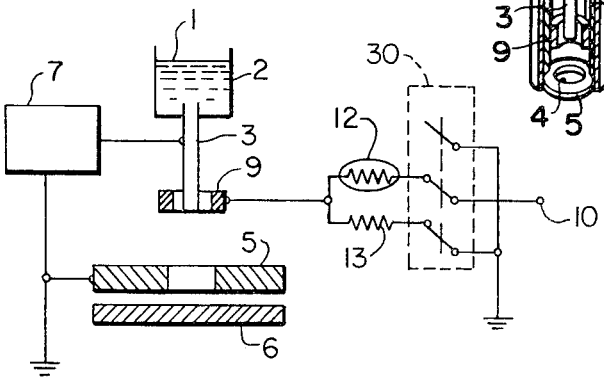
FIG.33

INK JET NOZZLE FOR USE IN A RECORDING UNIT

This is a division of application Ser. No. 418,283, filed Nov. 23, 1973.

CROSS-REFERENCE TO RELATED APPLICATION

Reference is made to the commonly assigned, copending application U.S. Ser. No. 417,543, entitled "Plural Liquid Recording Elements" by Genji Ohno et al now U.S. Pat. No. 3,911,448.

BACKGROUND OF THE INVENTION

1. Field of the Invention

This invention relates to a recording unit which records images by jetting a liquid imaging material, and more particularly to a recording unit which draws images by electrostatic generation of intermittent jetting of a liquid imaging material in response to a signal.

2. Description of the Prior Art

Facsimile is employed as one method for obtaining a picture in the form of an assembly of fine, linear or continuous, dotted line picture elements which are intermittent in accordance with a signal. As a recording method therefor, use has heretofore been made of, for example, the so-called spark printing process in which a surface layer previously formed on a recording member or medium such as paper, synthetic resin film or the like is ruptured as by discharge to expose a coloring material contained in the layer to thereby record images, or of the so-called electrostatic recording process in which an electrostatic latent image is formed as by corona discharge on the surface of a recording member previously insulated and then developed with a dry or liquid toner, electrophotographic recording process in which a latent image produced by irradiating the surface of a photosensitive recording member by a light beam is developed, or thermal development process.

These conventional methods are disadvantageous in the necessity of some previous treatment of the recording member and in involving a troublesome developing process. Further, one method that has been used for directly recording picture elements in an imaging material is to intermittently bring a recording unit such as a ball pen, a glass pen or the like into contact with a recording member. With this method, however, since the intermittent recording operation is achieved mechanically, it is low in response speed and noisy and, further, since recording is made by direct contact of the recording unit with the recording member, this method is not suitable for use with recording members whose surfaces are uneven and not smooth.

Further, with conventional recording units of the type employing jetting of a liquid imaging material, images being drawn are made intermittent by deflecting a previously generated jet by the pressure applied to the imaging material using an acceleration electrode and a deflection electrode, so that it is necessary to provide a removing device for receiving the imaging material during suspension of recording. Therefore, in the case of recording with one process by closely arranging many recording units, apparatus becomes inevitably complicated and bulky in its entirety.

SUMMARY OF THE INVENTION

An object of this invention is to provide a novel recording unit which is free from the aforesaid defects of the prior art and is simple in construction but high in response speed, and which permits ease in selecting the positive/positive or positive/negative mode of operation with respect to an input signal and enables stable convergent or unfluctuated jetting of a liquid imaging material.

In accordance with one aspect of this invention, the recording unit comprises a hollow, very small nozzle supplied with a liquid imaging material, and an electrode plate having a through hole coaxial with the nozzle and disposed opposite to the tip of the nozzle and a ring of small diameter disposed on the nozzle coaxially therewith in the vicinity of its tip or between the nozzle and the electrode plate. A convergent jet of the liquid imaging material generated by a voltage applied between the nozzle and the electrode plate, is directed through the through hole of the electrode plate to a recording member placed adjacent to the electrode plate on the opposite side from the nozzle and the convergent jet is made intermittent by applying a voltage to the ring, thereby intermittently recording an image.

In accordance with another aspect of this invention, the nozzle, which is formed with a very fine pipe and jets out a liquid imaging material having a surface tension of 20 to 80 dynes/cm and a viscosity of less than 200 centipoises, by impressing a high voltage above 1KV, is featured in that the radius of curvature of the outer edge portion of the open end portion of the nozzle is larger than 0.03mm and the width of the flat marginal portion contiguous thereto is less than 0.2mm.

In still another aspect of this invention, the lower end portion of the nozzle including at least the joint portion between the rounded outer edge portion and the outer peripheral surface of the nozzle is made liquid-repellent with respect to the liquid imaging material. Thus, a stable, convergent jet can be produced for a long time.

BRIEF DESCRIPTION OF THE DRAWINGS

This invention will be more fully understood by the following description and the attached drawings, in which:

FIGS. 31 and 32 are diagrams showing one example of recording apparatus embodying this invention and the construction of a recording unit employed therein, respectively; and FIG. 33 is a schematic diagram of another embodiment of the invention.

DESCRIPTION OF THE PREFERRED EMBODIMENTS

Figure 1:
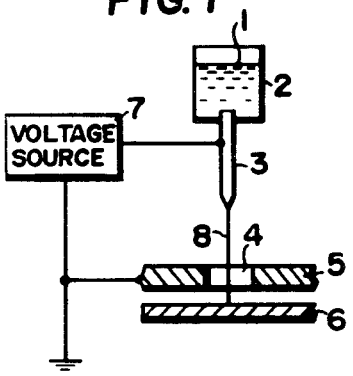
FIG. 1 is a diagram showing the basic principles of an ink jetting unit of this invention.

In FIG. 1, a hollow, very small nozzle 3 is supplied with a liquid imaging material 1 from a storage and supply tank 2, and an electrode plate 5, which has formed therein a through hole 4 coaxial with the nozzle 3, is disposed opposite to the nozzle 3. Adjacent to the electrode plate 5, a recording member or medium 6 formed as of paper, cloth, synthetic resin film, metal plate or the like is arranged on the opposite side from the nozzle. The nozzle 3 and the electrode plate 5 are connected to both electrodes of a high-tension voltage source 7, respectively. In the case where the liquid imaging material composed, for example, of the following materials:

| | |
|---|---|
| cyanine blue | 0.5 parts |
| methanol | 10 parts |
| glycerine | 5 parts |
| water | 85 parts |

is supplied to the nozzle 3, whose inner diameter is 0.25mm, and an electrostatic voltage is applied between the nozzle 3 and the electrode plate 5 to make the former positive relative to the latter. When this voltage reaches 1.8KV, the so-called liquid jet 8 of about 2000 droplets per second is generated from the tip of the nozzle 3. The liquid jet 8 passes through the through hole 4 of the electrode plate 5 and arrives at the recording member 6 and adheres thereto.

If the recording member 6 is driven or moved by a driving unit (not shown) relative to the nozzle 3, the locus of its travel is drawn by the droplets of the liquid jet in a linear or continuous dotted-line form on the recording member 6.

The voltage for the applied between the nozzle 3 and the electrode plate 5 may be a DC, ripple or AC voltage but in the case of the AC voltage, where its frequency is high, convergency of the jet is lowered. The polarity of the voltage may be positive or negative.

The imaging material 1 is composed mainly of water as a solvent as mentioned previously but may be composed of cyclohexane, toluene, xylene or other solvent. In general, any of liquid imaging materials which have a surface tension of 30 to 80 dynes/cm, a viscosity of less than 200cps and an electric resistance of higher than $10^{-3}\Omega$cm can be used in this invention. When the surface tension is below 30 dynes/cm, the jet is difficult to converge and when it is above 80 dynes/cm, wetting of the nozzle is poor to make it difficult to generate a convergent jet. With a viscosity of higher than 200cps, response of the intermittent operation is poor. An electric resistance of lower than $10^{-3}\Omega$cm makes it difficult to generate a jet, and hence is not desirable.

During jetting in the example of FIG. 1, a current of 0.1 to 1$\mu$A flows between the nozzle 3 and the electrode plate 5 and only a very weak current corresponding to 1/100 to 1/500 of the current flows from the nozzle 3 to the recording member 6. This corresponds to a charge of the droplet adhering to the recording member 6.

From this fact, it is considered that, in this invention, the liquid jet 8 of the droplets, which is generated by the electric field between the nozzle 3 and the electrode plate 5 together with a corona discharge, is converged under the pressure of corona charges and rushes to the electrode plate 5 along the electric field.

Further, it is considered that the corona charges of small mass are captured by the electrode plate 5 and that only the droplets of large mass pass through the through hole 4 of the electrode plate 5 and arrive at the recording member 6 by inertia of the droplets.

Accordingly, in the present invention, the recording member need not be placed in a corona electric field unlike in conventional methods, so that an electrode plate, which is disposed immediately below the nozzle in the prior art, is unnecessary. Therefore, the recording member 6 may be formed of paper, cloth, synthetic resin film, metal plate or the like irrespective of its insulating property, conductivity and dielectric constant. In addition, since the recording is effected without any mechanical contact of the recording unit with the recording member, it is possible to use any recording member regardless of uneveness or smoothness of its surface.

Figure 2:
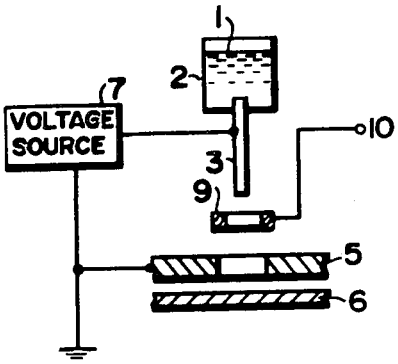
FIGS. 2 to 4, inclusive, are diagrams, for explaining positioning of a ring for intermittent jetting.
Figure 3:
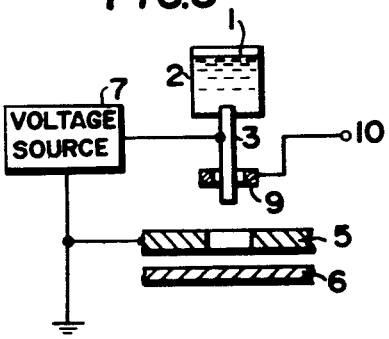
Figure 4:
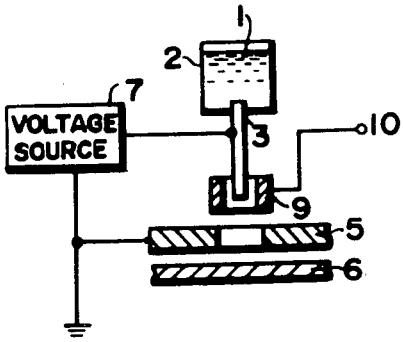

Next, as shown in FIGS. 2 to 4, a ring 9, which has an inner diameter of 4mm, is disposed coaxially with the nozzle 3 between the nozzle 3 and the electrode plate 5 or mounted on the nozzle 3 within a range of 5mm from its tip. Further, the ring 9 is connected to a terminal 10 through a lead.

The liquid jet of the imaging material is generated by applying a voltage 2.1KV between the nozzle 3 and the electrode plate 5 from the high-tension voltage source 7. Then, when a voltage 500V of the same polarity as the nozzle 3 is applied to the ring 9 through the terminal 10, the non-uniform electric field formed at the tip of the nozzle 3 is made uniform and weakened, so that the jet start voltage rises to stop the jet immediately. Then, upon removal of the applied voltage, jetting is produced again to record an intermittent image on the recording member 6. This interruption of the jetting can be effected more than several hundred times per second.

It is necessary that the voltage to be applied to the ring 9 for stopping the jet reduces the field intensity at the tip of the nozzle 3 to a value lower than that at which the droplets start dropping; but this voltage can be made lower than 200V by an appropriate selection of the diameter and position of the ring 9. Further, the upper limit of this impression voltage may be higher than the jetting voltage. As the diameter of the ring 9 becomes smaller, the jet stopping voltage becomes lower. However, a diameter of less than 1.0mm is likely to cause a discharge between the ring 9 and the nozzle 3, and too large a diameter leads to a rapid increase in the stopping voltage. An optimum range of the inner diameter of the ring 9 is 1.0 to 10mm.

It has been found that an increase in the outer diameter of the ring acts to make the electric field at the tip of the nozzle uniform so as to increase the jet starting voltage thereby reducing the voltage required to be applied to the ring for interrupting the jet but a ring outer diameter greater than 10 mm does not produce such an effect to any substantial degree.

Where the ring 9 is mounted on the nozzle 3 as depicted in FIG. 3, it is not stained by the spattering of the droplets due to impurities contained in the imaging material 1. With an increase in the distance between the ring 9 and the tip of the nozzle 3, the jet stopping voltage increases and when the distance is longer than 5mm, the stopping voltage rapidly increases. Even if the stopping voltages reaches the upper limit value of the jetting voltage between the nozzle 3 and the electrode plate 5, the jet cannot be stopped.

Where the tip of the nozzle 3 lies inside of the ring 9 as shown in FIG. 4, the jet stopping voltage is at a minimum and a change in the stopping voltage resulting from the difference in the position of the ring is also small.

Figure 5:
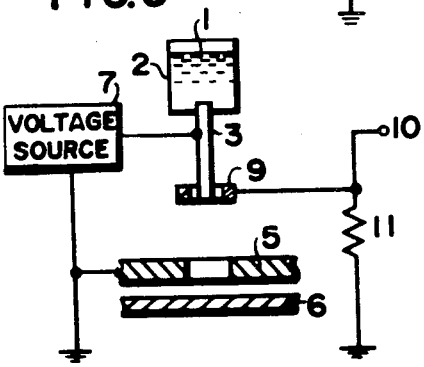
FIG. 5 is a diagram, for explaining a grounding resistor connected in circuit with the ring.

In the case of drawing an image through the use of the recording unit of this invention, the voltage of the ring 9 may be achieved by a method of indirectly applying a voltage by electrostatic induction or by a method of connecting the ring directly to the power source and turning it on and off by means of by means of a switch. In such a case, however, when the circuit is turned off, a residual charge is produced to thereby deteriorate the response for intermission. To improve the response, the ring 9 is grounded through a resistor 11 as shown in FIG. 5, whereby the response for intermission can be significantly enhanced. Too small a resistance value of the resistor 11 causes an increase in its power consumption, and too large a resistance value increases the decay time of the residual charge to result in deteriorated response for interruption. An optimum resistance value of the resistor 11 is in the range of $10^3$ to $10^{10}\Omega$.

Figure 6:
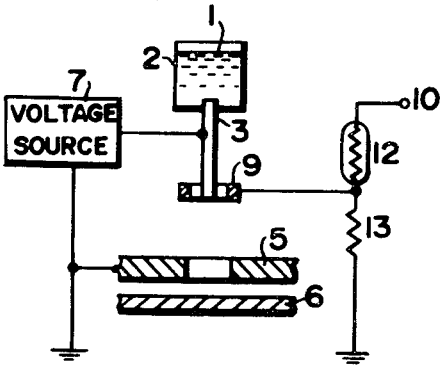
FIGS. 6 and 7 are diagrams, for explaining a control system employing a photoconductive switching element in circuit with the ring.

FIG. 6 illustrates an example of the recording unit of this invention, which is adapted to make the jet intermittent with a light signal by the employment of a photoconductive switching element 12. In FIG. 6, a photoconductive switching element 12 is connected between the terminal 10 and the ring 9. The resistance values $R_2$ and $R_2'$ of the element 12 when not irradiated by light and when irradiated by light, respectively, and the resistance value $R_1$ of a grounding resistor 13 of the ring 9 are selected such that $R_2>R_1>R_2'$. The terminal 10 is connected to a jet intermitting power source (not shown). Upon irradiation of the photoconductive switching element 12 by light, the resistance of the element 12 decreases and with no light, the voltage is applied to the ring 9 while the residual charge decays through the grounding resistor 13. In this case, an image, which is positive/positive with respect to the optical image, is recorded.

Figure 7:
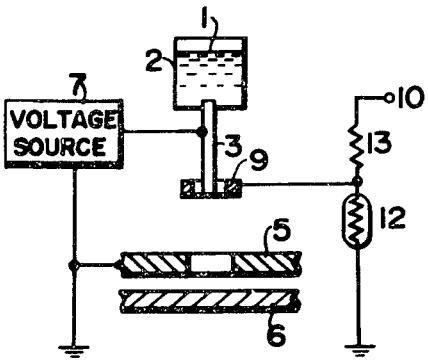

Further, even if the grounding resistor 13 is exchanged in position with the photoconductive switching element 12 as depicted in FIG. 7, an image corresponding to the optical image is obtained but, by contrast to the example of FIG. 6, when the photoconductive switching element 12 is irradiated by light, the jet is stopped and when the element 7 is not irradiated, the jet is generated, so that an image, which is positive/negative with respect to the optical image, is recorded.

Figure 8:
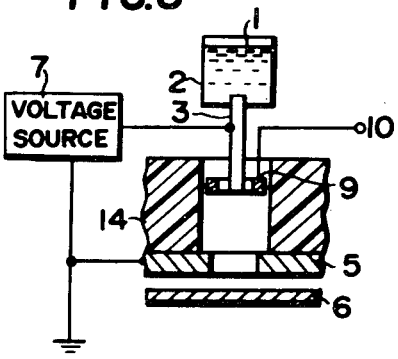
FIGS. 8 and 9 are diagrams, for explaining the case of employing an insulating dielectric.

The recording unit can be adapted to be actuable for selecting the positive/positive or positive/negative mode of operation by selectively connecting the jet intermitting voltage source terminal 10 and the ground, to the photoconductive switching element 12 connected with the ring 9 and the resistor 13 of $10^3$ to $10^{10}\Omega$ connected in parallel with the element 12. The photoconductive switching element 12 may be replaced with some other photo switching element such, for example, as a photo thyristor element. FIG. 33 shows a switch 30 arranged to be selectively movable between a first and second position, the switch being shown in one such position in FIG. 33. As described above, the photoelectric switching element 12 and resistor 13 are arranged in parallel relationship each having one end connected to the ring 9 and in the first position of the switch shown in FIG. 33, the other ends of the switching element 12 and resistor 13 are connected to the means for applying voltage to the ring and to ground respectively. Movement of the switch 30 into the second position, connects the other end of the resistor 13 to the voltage applying means designated by the number 10 and the other end of the switching element 12 to ground.

Where the corona discharge space, which extends from the vicinity of the tip of the nozzle 3 including the ring 9 to the electrode plate 5, is shielded with an insulating dielectric 14 disposed coaxially with the nozzle 3 as shown in FIG. 8, the convergency of the jet is greatly improved, and the upper limit voltage for the convergent jet is also raised to provide for enhanced stability in jetting. This effect appears to be obtained for the following reason. Namely, one part of the corona charge produced simultaneously with jetting is stored on the inner wall of the dielectric, and the electric field between the nozzle 3 and the electrode plate 5 is thereby repelled to be converged towards the through hole of the electrode plate 5, thereby exerting an influence on the jet. In our experiment conducted with the unit shown in FIG. 8, a ring 9 having an inner diameter of 4 mm and an outer diameter of 5 mm was mounted on a nozzle 3 having an inner diameter of 0.25 mm and an outer diameter of 0.5 mm with the underside of the ring 9 flush with the open end of the nozzle 3. The distance between the tip of the nozzle 3 and the electrode plate 5 was 4 mm. The diameter of the jetting space shielded by the insulating dielectric 14 was 5.5 mm and an ink jet started at 1.9 KV. However, when the insulating dielectric 14 was removed, the jet started at 1.85 KV and was intermittently branched at 2.7 KV.

Figure 9:
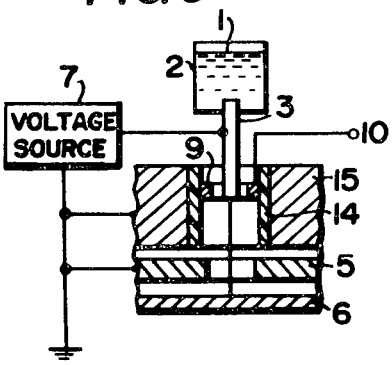

Such recording apparatus as shown in FIG. 9, in which the jetting space of each recording unit is shielded for preventing the influences of the electric fields of adjacent recording units, is shown in the above-identified, co-pending application. Where a cylindrical conductive shield member 15 is provided coaxially with the nozzle 3, the shield member 15 serves as an electrode, so that the jet is likely to be sprayed. In this case, however, the provision of an insulating dielectric 14 on the inside of the shield member 15 in contact therewith remarkedly enhances the convergency and stability of the jet.

An electric resistance of $10^7$ to $10^{14}\Omega$ is proper for the insulating dielectric 14. A resistance lower than $10^7\Omega$ lessens the effect of converging and stabilizing the jet, and a resistance higher than $10^{14}\Omega$ causes an increase in the jet start voltage and deteriorates the response for the intermittent operation.

The insulating dielectric 14 may be formed of an organic material such as phenol resin, polyvinyl chloride, polyethylene, acrylic resin, polystylene, ebonite, epoxy resin or the like or an inorganic material such as glass, porcelain.

The response for the intermittent operation can be remarkedly improved by grounding the ring 9 through the resistor 11 as described previously with regard to FIG. 5, but the connection of the resistance element with the external circuit of the ring introduces a complexity in the overall wiring and requires consideration for insulation and occupies more space. Thus, it is possible to incorporate the resistor in the recording unit and directly connect it to a grounded shield member or the electrode plate disposed opposite to the nozzle, as will hereinbelow be described in connection with FIGS. 10 and 11.

Figure 10:
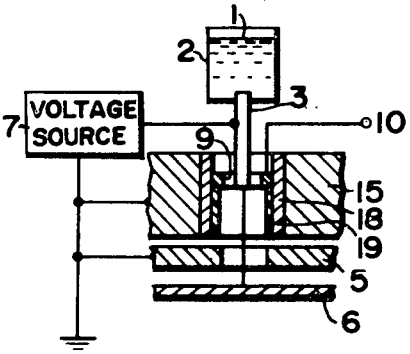
FIGS. 10 and 11 are diagrams, for explaining the case of employing a cylindrical resistor as a grounding resistor in FIG. 5.

In FIG. 10, a cylindrical resistor 18 is disposed inside of the cylindrical conductive shield member 15 to make conductive contact therewith, in place of the insulating dielectric 14 in FIG. 9, and the ring 9 is fixedly disposed inside of the cylindrical resistor 18 with its inner wall making conductive contact with the outer periphery of the ring 9. The cylindrical resistor 18 is a resistor formed of a solid resistance material or a semiconductor resistance material, such, for example, as a plastic molded resistor, and this resistor presents a resistance value of $10^3$ to $10^{10}\Omega$ between the ring 9 and the shield member 15. Thus, the resistor 18 is fixed to the shield member 15 and supports the ring 9 and, also, serves as a grounding resistor of the ring 9, providing for enhanced response speed for the intermittent jetting, as described previously. Further, a cylindrical insulating dielectric 19 is disposed in contact with the inside of the cylindrical resistor 18 and the underside of the ring 9 to cover the jetting space defined between the nozzle 3 and the electrode plate 5, whereby the same results as those obtainable with the insulating dielectric 14 in FIG. 9 can be obtained to converge and stabilize the jet.

Figure 11:
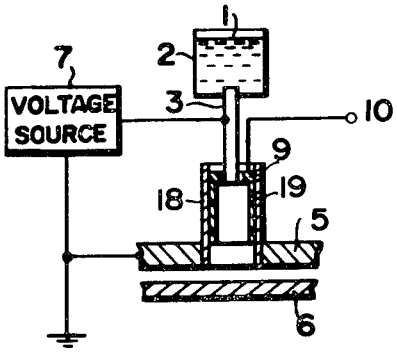

In FIG. 11, the cylindrical resistor 18 which makes conductive contact with the inner wall of the through hole of the electrode plate 5 is provided, and the ring 19 is fixedly disposed on the inside of the cylindrical resistor 18 with its inner wall making conductive contact with the outer periphery of the ring 9. Further, the insulating dielectric 19 is provided in contact with the inside of the cylindrical resistor 18 to cover the jetting space defined between the nozzle 3 and the electrode plate 5, thereby obtaining the same results as those with the construction of FIG. 10.

The following will describe first the mechanism for generation of the jet and then the shape of the nozzle, the relationship between the desired finishing of the nozzle and the jet, and the conditions for generating a stable, convergent jet.

Figure 12:
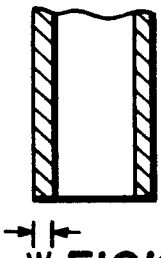
FIGS. 12 to 15, inclusive, are schematic diagrams showing various configurations of an ink jetting nozzle.
Figure 13:
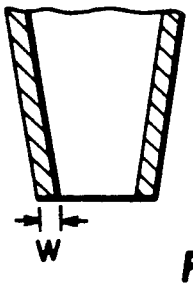
Figure 14:
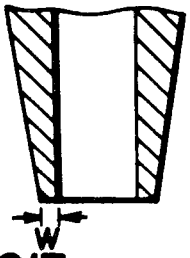
Figure 15:
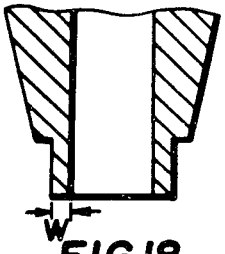

The shape of the nozzle may be such, for example, as shown in FIG. 12 in which the inner and outer diameters of the nozzle are constant, in FIG. 13 in which the lower end portion of the nozzle is tapered, in FIG. 14 in which the thickness of the nozzle is reduced as the open end portion is approached or in FIG. 15 in which the lower end portion of the nozzle is stepped. However, in such an event that the outer margin of the open end portion of the nozzle has an edge formed as by ordinary finishing, continuing to increase the jet voltage, the jet remains in an unstable convergent state for a little while and is then suddenly branched into several streaks or sprayed into fog. In some cases, no convergent jet of the imaging material is formed and a branched or sprayed jet is formed directly after dropping of the droplets.

The converging voltage for the liquid jet in the electrostatic ink jetting is affected by the surface tension and viscosity of the imaging material. Even with the nozzle having at its outer margin of the open end portion an edge resulting from ordinary finishing, it is possible to converge an imaging material having a surface tension of 40 to 60 dynes/cm and a viscosity up to 150 centipoises. However, even if nozzles of the same size and shape are used, the convergent voltage and its range are different according to the nozzles used and vary with the lapse of time, making the convergency of the jet extremely unstable.

With a surface tension of less than 40 dynes/cm, instability of the convergency further increases and the jet is branched or sprayed immediately following dropping of the droplets started with an increased voltage, and the converging voltage range becomes narrow. Even if the jet is converged, the number of droplets per second is small and the weight of each droplet increases. With a surface tension of larger than 60 dynes/cm, wetting of the tip of the nozzle becomes non-uniform, and the jet does not advance in a line and tends to be intermittent independently of the control for the intermittent operation. Further, a viscosity above 150 centipoises deteriorates the response for the intermittent operation and introduces dispersion in the jet to lower the quality of high-speed recording.

In the case where the tip of the nozzle has an edge at its outer margin and the width W of the flat marginal portion of the tip is large as depicted in FIGS. 12 to 15, the jet varies and is unstable and, with an increase in the voltage, the jet readily becomes branched into several jets or sprayed into fog.

Figure 16:
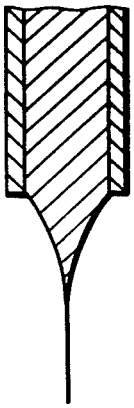
FIGS. 16 to 18, inclusive, are diagrams, for explaining the state of generation of a liquid jet.
Figure 17:
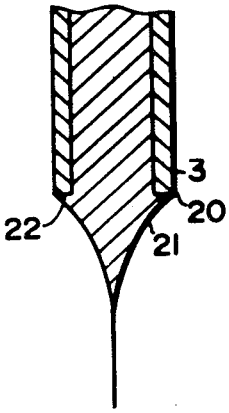

The liquid jet is generated from the inner side of the open end of the nozzle as shown in FIG. 16 or from the outer side of the open end wetting the flat marginal portion 22 of the nozzle as shown in FIG. 17.

Figure 18:
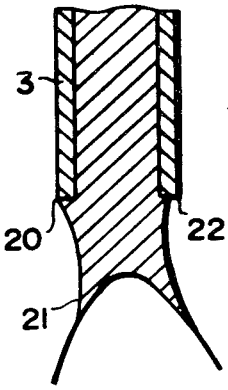

The jet generated from the inner side usually does not vary as much and is stable, but the jet generated from outer side varies greatly, is unstable and may be suddenly branched as shown in FIG. 18, in many cases. With the unstable jet of great vibration, the branching voltage is very low and the range of the voltage for the convergent jet is also narrow, for example, 100 to 200V in some cases. Further, the jet generated from the outer side such as shown in FIG. 17 is often sprayed into non-uniform fog after or before being branched.

Though dependent on the surface tension of the imaging material used, the jet generated from the inner side of the open end of the nozzle as shown in FIG. 16 also wets the flat marginal portion outwardly usually with the lapse of time, and finally it is generated from the outer side of the open end of the nozzle 3 as depicted in FIG. 17, if spread of wetting on the flat marginal portion transiently becomes non-uniform in a direction of its periphery to cause further vibrating of the jet, so that the jet is branched or sprayed at an early stage, as depicted in FIG. 18.

The jet generated from the outer side of the open end of the nozzle 3 is remarkedly unstable as compared with that generated from the inner side of the open end for the following reasons. Namely, the imaging material making contact with the outer edge 20 of the open end of the nozzle 3 in FIG. 18 is affected by strong corona discharge generated from the outer edge 20. Further, since the outer side 20 attracts dust or other impurities due to the electric field of high intensity, the corona discharge becomes non-uniform over the entire periphery of the open end of the nozzle 3, and the interface of the imaging material making contact with the outer edge 20 is made non-uniform by the impurities.

Figure 19:
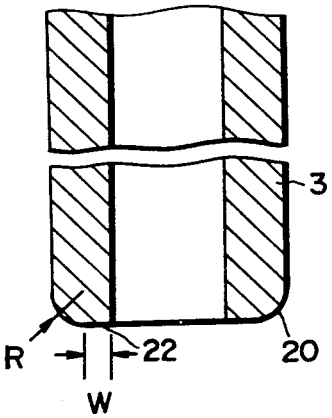
FIGS. 19 and 20 are explanatory diagrams showing the construction of examples of the nozzle according to this invention.

The present inventors conducted experiments with nozzles whose outer edges 20 were rounded with various radii of curvature R as shown in FIG. 19. As a result of our experiments, it has been found that radii of curvature more than 0.03mm extremely decreases the vibration of the jet and its branching or spraying to stabilize the jet even in the case of the jet being generated from the outer side of the open end of the nozzle 3, as shown in Table 1 in connection with one example of a nozzle having an inner diameter of 0.2mm and a thickness of 0.15mm.

Table 1

| nozzle | radius of curvature R of outer margin | converging jet voltage | range of voltage |
|---|---|---|---|
| non-treated | less than 0.01mm | 2.3~2.4KV | 100V |
| chemically polished 2 minutes | 0.01~0.02 | 2.3~2.4 | 100 |
| 5 | 0.02~0.03 | 2.3~2.5 | 200 |
| 8 | 0.03~0.05 | 2.1~2.5 | 400 |
| 13 | 0.05~0.12 | 2.1~2.6 | 500 |

In the case where a nozzle, which was formed of a pipe made of stainless steel, having a 0.3mm thickness and a 0.3mm inner diameter, and washed with a solvent after barrel finishing in a known manner, was employed in the unit of FIG. 1 to produce an electrostatic jet of the aforesaid liquid imaging material, droplets started to drop at 2.3KV and the jet was suddenly branched at 2.4KV. However, by chemical polishing of the tip of the nozzle with a saturated solution of ferric chloride for 8 minutes with vigorous stirring to round the outer edge of the open end of the nozzle at a radius of curvature of more than 0.03mm, dropping of droplets started at 2.0KV and an excellent convergent jet was obtained. The convergent state continued up to 2.5 KV and no branching occurred at higher voltages. In a nozzle subjected to barrel finishing only, a discharge generated from the sharp edge of the outer side of the open end caused the jet to be branched in the direction of the discharge but in a nozzle whose outer edge of the open end was rounded by chemical polishing to have a radius of curvature more than 0.03mm, spreading of the imaging material at the tip of the nozzle was uniform.

Figure 20:
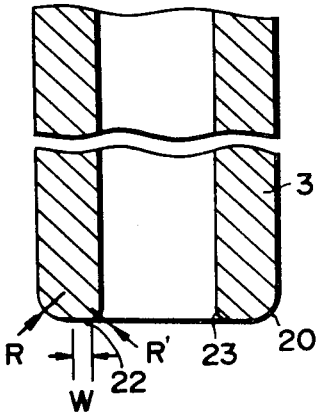

The radius of curvature R′ of the inner edge 23 of the open end of the nozzle 3 such as depicted in FIG. 20 does not exert so much influence on stabilization of the jet as that of the outer edge but provides good results.

It is preferred that the flat marginal portion of the open end of the nozzle is as narrow as possible so as to prevent the aforementioned unwanted phenomenon in the period of transition of the jet from the state of FIG. 16 to that of FIG. 17.

According to our experiments, where the width W of the flat portion of the open end of the nozzle is less than 0.2mm, preferably less than 0.1mm, the jet does not vibrate as much and, where the portion is more than 0.2mm, vibration of the jet increases greatly and becomes sprayed or branched at a low voltage and the jet start voltage increases.

As shown in the Table 2, of the jets generated from nozzles which are 0.3mm in inner diameter, 0.3mm, 0.2mm, 0.1 mm and 0.05mm in the width of the flat portion of their open ends, respectively and 0.03mm in the radius of curvature of the outer edge, the jets from the nozzles in which the flat portions are wider than 0.2mm vibrate greatly, but the width of less than 0.2mm rapidly decreases the vibration of the jet and lowers the convergent jet starting voltage, too.

Table 2

| Width of flat portion | Converging voltage | range of voltage | stability after intermitted 100 times |
|---|---|---|---|
| 0.3mm | 2.3~2.4KV | 100V | great vibration and intermittent |
| 0.2 | 2.2~2.5 | 300 | excellent |
| 0.1 | 2.1~2.6 | 400 | excellent |
| 0.05 | 2.1~2.6 | 500 | excellent |
| less than 0.1 | 2.0~2.6 | 600 | excellent |

Further, in the case of the width of the flat portion being less than 0.2mm, even if an imaging material employing a liquid of low surface tension such as methanol, xylene or acetone is used, a stable convergent jet can be obtained, so that the range of the surface tension of the imaging material used can be enlarged to be 20 to 80 dynes/cm.

In general, the relationship between the viscosity of the imaging material and the jet is such that an increase in the viscosity of the imaging material causes an increase in the jetting voltage and a decrease in the response speed for the intermittent operation. However, where the width of the flat marginal portion of the open end of the nozzle is less than 0.2mm, the response is greatly improved, so that imaging materials of high viscosity in the range of 150 to 200 centipoises can also be used as will be apparent from the Table 3.

Figure 21:
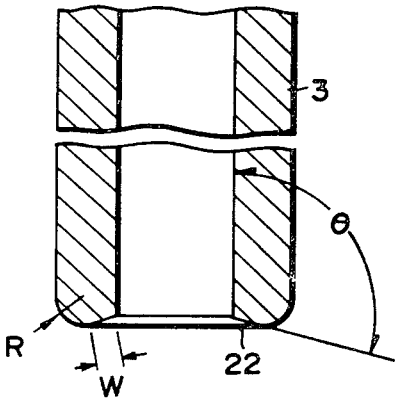
FIGS. 21 to 23, inclusive, are explanatory diagrams for modified forms of the nozzle according to this invention.
Figure 22:
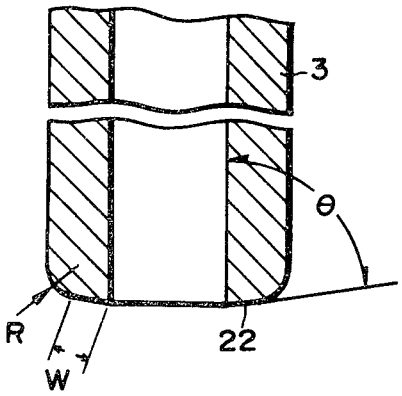

With reduced width of the flat marginal portion of the open end of the nozzle, the jet starting voltage is lowered, so that an imaging material 1, for example, methanol, acetone or the like having a surface tension of less than 40 dynes/cm can be employed without causing splaying the jet.

Where the angle $\theta$ of the flat portion 22 to the inner edge of the open end of the nozzle 3 is in excess of 90° as shown in FIG. 21, the influence of the flat portion on the jet is slight and where the angle $\theta$ is smaller than 90° as depicted in FIG. 22, the influence of the flat portion on the jet is great, as when the angle $\theta$ is larger than 85°, but this influence decreases when the angle $\theta$ is smaller than 85°.

Table 3

Figure 23:
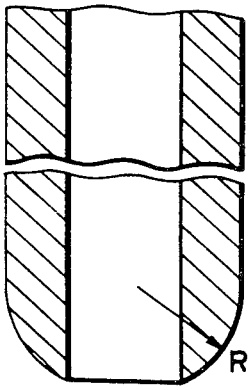

| viscosity of imaging material | Width of flat portion 0.3mm | 0.2mm | 0.1mm | 0.05mm |
|---|---|---|---|---|
| 200cps | intermittent jet | slightly vibration | excellent | excellent |
| 100 | " | excellent | " | " |
| 30 | great vibration | " | " | " |
| 1 | sprayed | " | " | " |

Where the width W of the flat portion of the open end of the nozzle 3 is nearly zero as in the case of FIG. 23, the jet is very stable but it is necessary to consider the influence of the polishing conditions and any flaws at the tip of the nozzle on the jet.

As has been described in the foregoing, by selecting the radius of curvature of the outer edge of the open end of the nozzle and the width of the flat marginal portion contiguous thereto to be more than 0.03mm and less than 0.2 mm, respectively, vibrating, branching and spraying of the jet can be avoided and the converging voltage range can be enlarged.

Figure 24A:
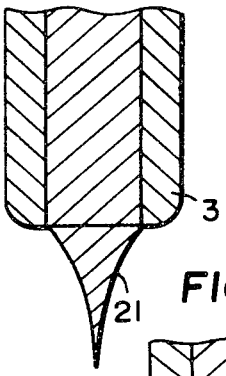
FIGS. 24*a* to 24*c*, inclusive, are diagrams, for explaining the state of jetting with the nozzle according to this invention.
Figure 24B:
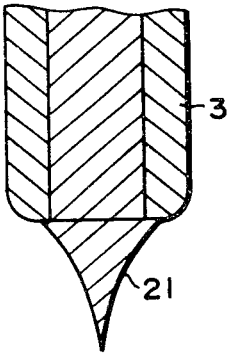
Figure 24C:
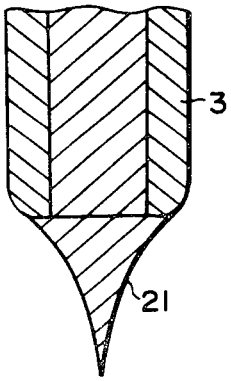
Figure 25:
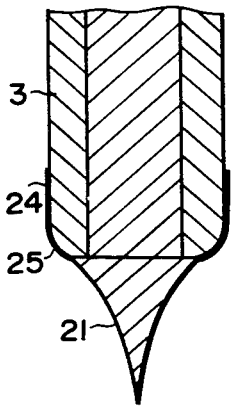
FIGS. 25 to 27, inclusive, are diagrams illustrating the construction of other examples of the nozzle according to this invention and for explaining their function.
Figure 26:
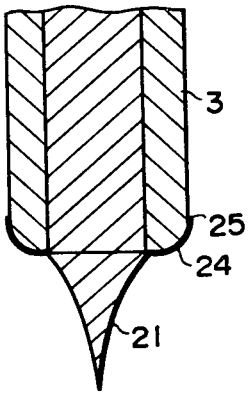
Figure 27:
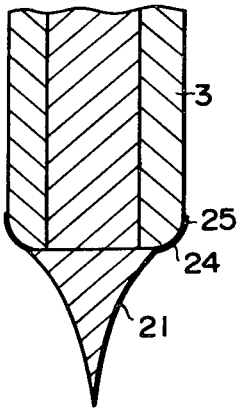

With a nozzle in which the radius of curvature of the rounded outer edge of the open end is more than 0.03mm and the width of the flat portion contiguous thereto is less than 0.2mm, the jet is stabilized in any of the states shown in FIGS. 24*a* to 24*c*. Where the surface tension is large, the jet is generated from the inner edge of the open end as depicted in FIG. 24*a* in many cases and where the surface tension is small, the jet is generated from the outer edge of the open end as shown in FIG. 24*c* in many cases. The jet sometimes changes from the state of FIG. 24*a* to that of FIG. 24*c* with the lapse of time. But, in the case of the flat portion being narrower than 0.2mm, the jet hardly becomes unstable in its transient state. If a liquid repellent layer 24 which repels the imaging material is formed partly or entirely on the lower end portion including a joint 25 between the rounded outer edge of the open end and the outer peripheral surface as shown in FIGS. 25 to 27, the jet hardly changes from the state of FIG. 24*a* to that of FIG. 24*c* and is further stabilized.

Figure 30:
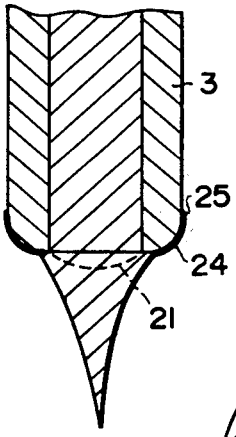
FIGS. 28 to 30, inclusive, are diagrams, for explaining the effect of the nozzle of this invention.
Figure 29:
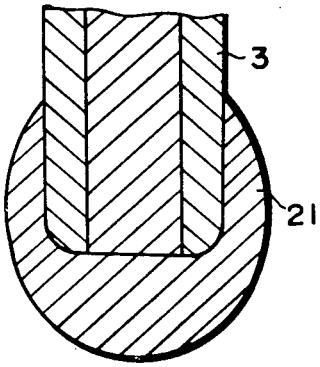
Figure 28:
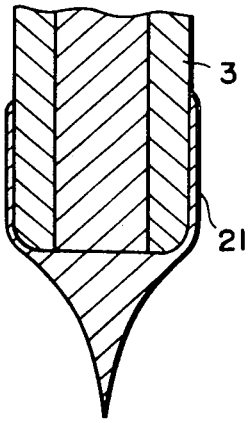

Generally, where no liquid repellent layer is formed on the lower end portion of the nozzle 3 including the joint between the rounded outer edge of the open end and the outer peripheral surface of the nozzle 3, if a voltage higher than a required voltage is applied, the imaging material sometimes gradually crawls up the outer peripheral surface over the joint 25 as shown in FIG. 28. In this case, if the jet is stopped, a droplet is formed at the tip of the nozzle 3 as illustrated in FIG. 29, which delays the response at the subsequent jetting and disturbs the jet. With the provision of the liquid repellent layer 24, however, the imaging material is prevented thereby from crawling up and even if it crawls up on the layer 24, it reaches only the joint 25 which is greatly affected by the electric field. Even in this case, the imaging material having climbed up to the joint 25 gathers at the open end portion of the nozzle 3 during suspension of the jetting as indicated by a broken line in FIG. 30, so that it neither disturbs the subsequent jetting nor delays the response.

Further, the liquid repellent layer on the rounded edge portion further suppresses discharge from the outer edge of the open end portion, so that the jetting voltage is centered on the imaging material at the tip of the nozzle, and consequently it is possible to start jetting at a voltage lower by 100 to 200V than in the case of the nozzle having no liquid repellent layer.

Since the intensity of electric field established at the tip of the nozzle 3 is the highest at the outer edge of the open end portion and rapidly decreases on the outer peripheral surface of the nozzle 3 contiguous to the outer edge, it is sufficient to form the liquid repellent layer 24 to cover at least the joint 25 between the rounded outer edge portion of the open end portion of the nozzle 3 and its outer peripheral surface. The liquid repellent layer 24 need not be extended further upwardly of the joint 25 for attaining the object of this invention.

The liquid repellent material for this invention which is suitable for use with the liquid imaging material may be such a resin as poly-4 fluoro ethylene resin, poly-3 fluoro ethylene resin, polyethylene resin or silicone resin, silicone varnish or the like. Any other material may be used so long as it decreases the interfacial tension of an imaging material having a surface tension in the range of 20 to 80 dynes/cm and prevents the imaging material from crawling up the outer peripheral surface of the nozzle over the joint between it and the outer edge of the open end portion of the nozzle during impression of a voltage.

The nozzle for ink jetting according to this invention described above can easily be made by cutting a fine pipe as of stainless steel, copper, brass or iron into predetermined length and cleaning its surface and then finishing it by known chemical etching with ferrous chloride, sulfuric acid, a mixed solution of nitric acid and hydrochloric acid or the like. In the chemical etching, it is necessary to prevent the etchant from entering the portion of the pipe where etching is not required, especially the inner surface of the pipe. The above metal materials are workable with mechanical polishing or electrolytic etching but, in the case of mechanical polishing, care should be taken so that the pipe may not be clogged with abrasive grains.

The nozzle according to this invention can also be made of a pipe as of glass or plastic, which is produced by subjecting it to a treatment for making its interior surface conductive by plating or other known method and then extending it by heating. In this case, the outer edge of the open end portion of the nozzle is fused by heating to be curved at a predetermined radius of curvature.

The nozzle having formed thereon the liquid repellent layer can be obtained by coating and drying a solution of the liquid repellent material on the outer peripheral surface and the lower end portion of the pipe or by spraying powder of the liquid repellent material on the surface of the pipe preheated. Further, it is also possible to employ an electrostatic coating method using the pipe as the one electrode or other known coating methods.

In the process of forming the liquid repellent layer, it is necessary to prevent the liquid repellent material from entering the inside of the pipe as by blowing air into the pipe or other suitable method.

Where the liquid repellent material does not well adhere to the pipe, the surface of the pipe is previously treated with a known primer such, for example, as an organic titanate for polyethylene and then the liquid repellent treatment is performed.

EXAMPLE 1

A nozzle made of a pipe of stainless steel, which had an inner diameter of 0.25mm and an outer diameter of 0.6mm and in which the rounded outer edge of the one open end portion had a radius of curvature of 0.03mm and the flat marginal portion contiguous to the rounded edge was 0.15mm wide, was used with the apparatus of FIG. 9. The nozzle 3 was supplied with the liquid imaging material 1 of the following composition from the storage and supply tank 2:

| | |
|---|---|
| cyanine blue | 0.5 parts |
| methanol | 10 parts |
| glycerine | 5 parts |
| water | 85 parts |

The electrode plate 5 having formed therein a through hole 5mm in diameter was disposed adjacent to the nozzle 3 with the through hole being coaxial therewith. At the tip of the nozzle 3, the ring 9 having an inner diameter of 4mm was disposed coaxially with the nozzle 3. Further, the space defined between the tip of the nozzle 3 including the ring 9 and the electrode plate 5 was shielded with the cylindrical member 14 made of acrylic resin, and the grounded conductive member 15 was disposed on the outside of the member 14 to shield it.

When a voltage of 2.5KV was applied between the nozzle 3 and the electrode plate 5, a very stable convergent jet was obtained and a linear image was recorded on the record member 6 travelling below the through hole 4. When a voltage 500V of the same polarity as the nozzle 3 was applied to the terminal 10 connected to the ring 9, the jet was completely stopped and, upon removal of the voltage applied to the ring 9, a stable jet was generated again which was free from vibration, branching and spraying.

Further, similar experiments were conducted with applied voltages in the range of 2.1 to 2.6KV but the jet never vibrated, branched and sprayed.

In similar experiments with the apparatus of FIG. 9 which employed a nozzle which had an inner diameter of 0.25mm and an outer diameter of 0.6mm and the one end of which was smoothed by electrolytic etching for 1 to 3 seconds after usual barrel finishing, a convergent jet could not be produced at a voltage lower than 2.3KV and the jet branched extremely at 2.5KV.

EXAMPLE 2

A pipe of brass which was 0.2mm in inner diameter and 0.6mm in outer diameter, was used as the nozzle. The outer edge of its one open end portion was rounded to have a radius of curvature of 0.05mm by means of chemical etching with a saturated solution of ferrous chloride. Low-molecular weight polyethylene powder was coated on the outer peripheral surface and the open end portion of the nozzle to a thickness of about 20$\mu$m by an electrodepositing and fusing method. In experiments similar to those in the example 1, a stable jet free from trembling was obtained at a voltage in the range of 2.05 to 3.2KV.

EXAMPLE 3

The nozzle of the same type as that in the example 2 was used but the flat portion 0.1mm wide which was contiguous to the inner edge of the open end portion, was not treated with the liquid repellent material. In experiments similar to those in the foregoing examples, a stable jet free from vibration was obtained at the impression voltage in the range of 2.1 to 3.1KV, and the initial stability of the jet was maintained after continuous intermittent operation.

As has been described in the foregoing, in the jet nozzle made of a very small pipe by means of which the liquid imaging material having a surface tension of 20 to 80 dynes/cm and a viscosity of less than 200 centipoises is jetted by the application of a high voltage above 1KV, the outer edge of its open end portion is rounded to have a radius of curvature larger than 0.03mm, by which corona discharge from the outer edge portion is reduced and made uniform, thus ensuring to avoid instability of the jet resulting from the corona discharge. Further, by selecting the width of the flat marginal portion of the open end of the nozzle contiguous to the outer edge to be less than 0.2mm, non-uniform spreading of the imaging material towards the flat marginal portion is suppressed, thereby to stabilize the basic condition for the convergent jet and enlarge the ranges of surface tension and viscosity of the imaging material used.

Moreover, the lower end portion of the nozzle including at least the joint between the rounded outer edge and the outer peripheral surface of the nozzle is made liquid-repellent, by which the imaging material is prevented from spreading on the outer peripheral surface of the lower end portion of the nozzle during the application of the voltage, thereby to enhance convergency and durability of the jet and lower the jetting voltage.

FIG. 31 illustrates one example of the recording apparatus in which a plurality of recording units 17 of this invention are closely arranged for recording a picture in one process. In FIG. 31, the recording units 17 are supplied with the liquid imaging material 1 from the liquid imaging material storage and supply tank 2.

Each of the recording units 17 is connected with a photoconductive switching element 12 through a lead 16. Each photoconductive switching element 12 is properly irradiated by light to cut off a jet intermitting power source (not shown), whereby a picture is recorded on the recording member 6 travelling relative to each nozzle.

FIG. 32 is a detailed cross-sectional view of one example of the recording unit employed in the example of FIG. 31. The electrode plate 5 having the through hole 4 is disposed in opposing relation to the tip of the hollow, very small nozzle 3 attached to the bottom of the imaging material storage and supply tank 2 and the ring 9 for intermittent jetting is provided between the lower end portion of the nozzle and the electrode plate 5. The jetting space defined between the tip of the nozzle 3 and the electrode plate 5 is shielded with the insulating dielectric 14 coaxially with the nozzle 3 and the conductive shield member 15 is disposed outside of the dielectric 14 to shield it. The shield member 15 is of particular utility when employed for shielding the influence of adjacent ones of the recording units 17 arranged close to each other, as described previously. The lead 16 corresponds to the lead indicated by the same reference numeral in FIG. 31, which is a lead for a signal input to each recording unit and is connected to the ring 9 of each recording unit.

As has been described in the foregoing, the recording unit of this invention achieves recording of an image by intermittent jetting of a liquid imaging material and hence thus, electrostatically. Neither pressure unit such as a pump (or the like) nor auxiliary means such as an acceleration electrode (or the like) are required. Further, the jetted droplets pass through the through hole of the electrode plate disposed opposite to the nozzle and then hit and adhere to the recording member, so that the recording member does not lie in the corona discharge space and an electrode plate need not always be provided on the underside of the recording member. Moreover, since the recording member does not require a special insulating property, conductivity, dielectric constant and etc., various materials such as paper, cloth, synthetic resin film, metal plate and etc. can be employed as the recording member and, in addition, since recording is achieved in a contactless manner, a recording member of uneven or rough surface can also be used. Further, since various materials can be used as the liquid of the imaging material, especially water and a liquid containing water can be employed, such danger and defect as fire, poison, odor and so on can be completely avoided.

In the recording unit of this invention, by disposing the ring of small diameter on the nozzle within the range of 5mm from the tip of the nozzle or between the nozzle and the electrode plate disposed opposite thereto and especially by disposing the open end portion of the nozzle in the cylindrical ring of small diameter, a convergent jet can be made intermittent by easily without requiring any mechanical operation. Further, a device for removing the imaging material during the jet forming and any other devices are not necessary, so that the recording unit is simple in construction and the recording apparatus comprising many recording units can be readily made in a small configuration.

Moreover, the response speed for intermittent jetting can be remarkedly enhanced by connecting with ground the aforementioned ring of the recording unit using a grounding resistor having a resistance value of $10^3$ to $10^{10}\Omega$. By selectively connecting the connection of the jet intermitting voltage source and ground to the photoconductive switching element connected to the ring and the resistor of $10^3$ to $10^{10}\Omega$ connected in parallel therewith, it is possible to easily reverse the relation between the optical image and the picture from positive/positive to positive/negative and vice versa.

Further, the jetting space defined between the lower end portion of the nozzle and the electrode plate is shielded by the dielectric disposed coaxially with respect to the nozzle, and this remarkedly enhances convergency and stability of the jet, coupled with the aforesaid selection of the shape of the nozzle.

It will be apparent that many modifications and variations may be effected without departing from the scope of the novel concepts of this invention.

What is claimed is:

1. A hollow nozzle for use in a recording unit wherein said hollow nozzle has an open end defining a tip for directing a jet of liquid imaging material from said nozzle and said recording unit comprises means for supplying a liquid imaging material to said nozzle; an electrode plate having a through hole and disposed opposite to said nozzle with said through hole being coaxial with said nozzle; means for disposing a recording member adjacent said electrode plate on the opposite side from said nozzle; a ring having an inner diameter greater than the outer diameter of said nozzle disposed in close proximity to said nozzle tip and in coaxial relationship therewith; means for applying a voltage between said nozzle and electrode plate to create a first electric field therebetween having a high intensity, non-uniform component in the vicinity of said nozzle tip to form the liquid imaging material in said nozzle into a jet and to direct said jet through said hole of said electrode plate to said recording member; and means for applying a voltage to said ring to generate a second electric field of the same polarity as the high intensity component of said first electric field in the vicinity of said nozzle tip to reduce the level of said high intensity component field and to impart uniformity to said high intensity component field thereby raising the voltage level at which jettir.g of said liquid imaging material from said nozzle tip occurs to interrupt said jet for recording an image on said recording member, said nozzle comprising:

a tubular element defining at one end thereof said open end tip of said nozzle and having a flat marginal end face at said one end, of a width less than 0.2 mm, the outer edge portion of said tubular element adjacent said one end and integrally joining said marginal end face being of arcuate shape and having a radius of curvature of less than 0.03 mm.

2. The hollow nozzle as recited in claim 1, wherein said marginal end face forms an angle of less than 85° with respect to the axis of said tubular element.

3. The hollow nozzle as recited in claim 1, wherein said marginal end face forms an angle greater than 90° with respect to the axis of said tubular element.

4. The hollow nozzle as recited in claim 1, wherein said tubular element having an outer surface tapering from a larger outer diameter to a smaller outer diameter at said open end tip.

5. The hollow nozzle as recited in claim 4, wherein said tubular element adjacent said open end thereof includes a short axial portion of a fixed outer diameter and a stepped edge connecting said short axial portion of fixed diameter to said tapered outer surface.

6. The hollow nozzle as recited in claim 1, wherein said tubular element is formed of a conductive material.

7. The hollow nozzle as recited in claim 1, wherein the inner surface of said tubular element is conductive.

8. The hollow nozzle as recited in claim 3, wherein the inner surface of said tubular element is conductive.

9. The hollow nozzle as recited in claim 1, wherein a liquid repellant coating is provided on the outer surface of arcuate shape.

10. The hollow nozzle as recited in claim 3, wherein a liquid repellant coating is provided on said flat marginal end and on said outer surface of arcuate shape.

11. A hollow nozzle for use in an electrical ink jet recording unit comprising: a tubular element having first and second ends and an axially extending passage therethrough for transporting liquid imaging material from said first end to said second end thereof to form a jet of said liquid imaging material from said second end; said second end of said tubular element having a flat marginal end face of a width less than 0.2mm, the outer edge portion of said tubular element adjacent said second end and integrally joining said marginal end face being of arcuate shape and having a radius of curvature less than 0.03mm.

12. The hollow nozzle as recited in claim 11, wherein said flat marginal end face forms an angle of less than 85° with respect to the axis of said tubular element.

13. The hollow nozzle as recited in claim 11, wherein said flat marginal end face forms an angle greater than 90° with respect to the axis of said tubular element.

14. The hollow nozzle as recited in claim 11, wherein a liquid repellent coating is provided on the outer surface of said arcuate shape.

15. The hollow nozzle as recited in claim 13, wherein a liquid repellant coating is provided on said flat marginal end and on said outer surface of arcuate shape.

* * * * *

UNITED STATES PATENT AND TRADEMARK OFFICE

CERTIFICATE OF CORRECTION

PATENT NO. : 3,941,312

DATED : March 2, 1976

INVENTOR(S) : GENJI OHNO et al

It is certified that error appears in the above-identified patent and that said Letters Patent are hereby corrected as shown below:

Column 5, line 24, delete "by means of" (second occurrence).

Column 10, line 41, "splaying" should be --spraying of--.

Signed and Sealed this

*eighteenth* Day of *May 1976*

[SEAL]

*Attest:*

RUTH C. MASON
*Attesting Officer*

C. MARSHALL DANN
*Commissioner of Patents and Trademarks*